US005289714A

United States Patent [19]

Corcoran

[11] Patent Number: 5,289,714

[45] Date of Patent: Mar. 1, 1994

[54] DEVICE FOR DEFORMING A SMOOTH SURFACED PIPE

[75] Inventor: Daniel P. Corcoran, Grandville, Mich.

[73] Assignee: Corcoran Industries, Inc., Grandville, Mich.

[21] Appl. No.: 43,029

[22] Filed: Apr. 5, 1993

Related U.S. Application Data

[62] Division of Ser. No. 881,262, May 11, 1992.

[51] Int. Cl.[5] ..... B21P 7/06

[52] U.S. Cl. ..... 72/453.16; 72/453.15

[58] Field of Search ..... 72/453.15, 453.16

*Primary Examiner*—David Jones

*Attorney, Agent, or Firm*—Robert L. McKellar

[57] ABSTRACT

The invention described herein deals with a novel tool that will enable one to deform smooth pipe and pipe segments for use in building pipelines, wherein the deformation is used as the anchor point for pipe couplings.

1 Claim, 2 Drawing Sheets

DEVICE FOR DEFORMING A SMOOTH SURFACED PIPE

This is a divisional of copending application(s) Ser. No. 07/881,262 filed on May 11, 1992.

The invention disclosed herein deals with a device for deforming a smooth surfaced pipe. Generally in the field of pipes and pipe fittings for pipe line assemblies that are constructed for conveying fluids under pressure, there are used several different types of standard pipe including grooved, ridged, rolled, beaded, threaded and smooth, this typing indicating the configuration of the outer surface of the pipe that is adaptable to the various pipe couplings that are available to the industry. The threaded pipe of course requires threaded pipe fittings, while the grooved, ridged, rolled, and beaded types of pipe require fittings that will fit behind such deformations in order for the coupling to hold the pipe ends in alignment and somewhat rigidly.

Just recently in the industry, there has been an increased use of smooth pipe on a limited basis. Smooth pipe does not have any deformations or designed configurations on its outer surface to accomodate pipe couplings. Thus, pipe couplings utilized on this type of pipe require a special coupling that is not analogous to those that are currently used in the industry for threaded, and or grooved pipe and the like, and likewise, these couplings must be especially designed to accomodate the smooth surface of the pipe.

One such special type of coupling is that disclosed by Daniel P. Corcoran in U.S. patent application Ser. No. 753,450, filed on Aug. 30, 1991 and having the title "Novel Pipe and Pipe Fittings And Methods For Securing Pipe", in which Corcoran discloses a type of fitting for coupling smooth pipe segments.

These couplings allow for the inexpensive installation of pipelines while at the same time maintaining the integrity of the pipeline system. A further advantage is that the devices of that application will not rotate circumferentially about the pipe once they are installed and further, the couplings will safely lock pipe systems together without projecting anything into the interior of the pipe that substantially inhibits the flow of any fluid conveyed by the pipeline to give a free flow characteristic to the pipeline system. This is true because of the unique configuration of the device and its adaptive deformations on the ends of the pipe of the pipeline itself.

Corcoran's method of joining pipe and pipe segments requires that the pipe or pipe segment be pre-prepared before the placement of the coupling thereon and the method comprises forming a metal deformation on the outside surface of each pipe segment a predetermined distance from each pipe end to obtain the pre-prepared pipe ends.

The invention described herein deals with a novel tool that will enable one to prepare pre-prepared pipe and pipe segments for use in the Corcoran piping methods.

THE INVENTION

The devices of the present invention help overcome the prior art problems of coupling smooth pipe and pipe segments in the field during installation.

The inventive tools allow for the inexpensive installation of pipelines while at the same time providing quality pipeline segments and systems.

With specificity, this invention comprises a device for deforming a smooth surfaced metal pipe, the device comprising in combination a power source, and connected thereto, a deforming head, said deforming head comprising a hydraulic block containing a hydraulically operated piston wherein the hydraulic block has a front wall, back wall, outside wall, inside wall, a top, and a bottom wherein the hydraulic block has on it back wall at least one entry port. There is connected to each said entry port, a hydraulic fluid line, the combination of the entry port and hydraulic line being for the transfer of pressurized hydraulic fluid into and out of the hydraulic block to operate a piston situated therein.

The hydraulic block has mounted on its bottom, a pipe stop. The pipe stop has an exposed back surface and an exposed under surface, wherein the pipe stop is located near the back wall of the hydraulic block. The pipe stop has mounted on its exposed under surface, a holder, and the holder has an exposed back wall an under surface and a front upper surface with a center point on it. The upper surface of the pipe stop has mounted near its center point, a deforming pin and the hydraulic block has mounted on its bottom near the front wall, a die holder, and the die holder is situated such that any die located therein will be in vertical alignment with the deforming pin.

The pipe stop and holder are preferably rigidly cojoined at their exposed back walls by a reinforement block.

The pipe stop, holder and reinforcement block form a subcombination which subcombination is adjustable in a vertical line and removable from the hydraulic block. The subcombination is held by an adjustable threaded fastener wherein the adjustable threaded fastener is insertably mounted through a vertical hole in the hydraulic block into a threaded vertical hole in the pipe stop which accomodates the adjustable threaded fastener. The hydraulic block is rigidly attached to the power source by a mounting bracket.

DETAILED DESCRIPTION OF THE INVENTION

Figure 1:
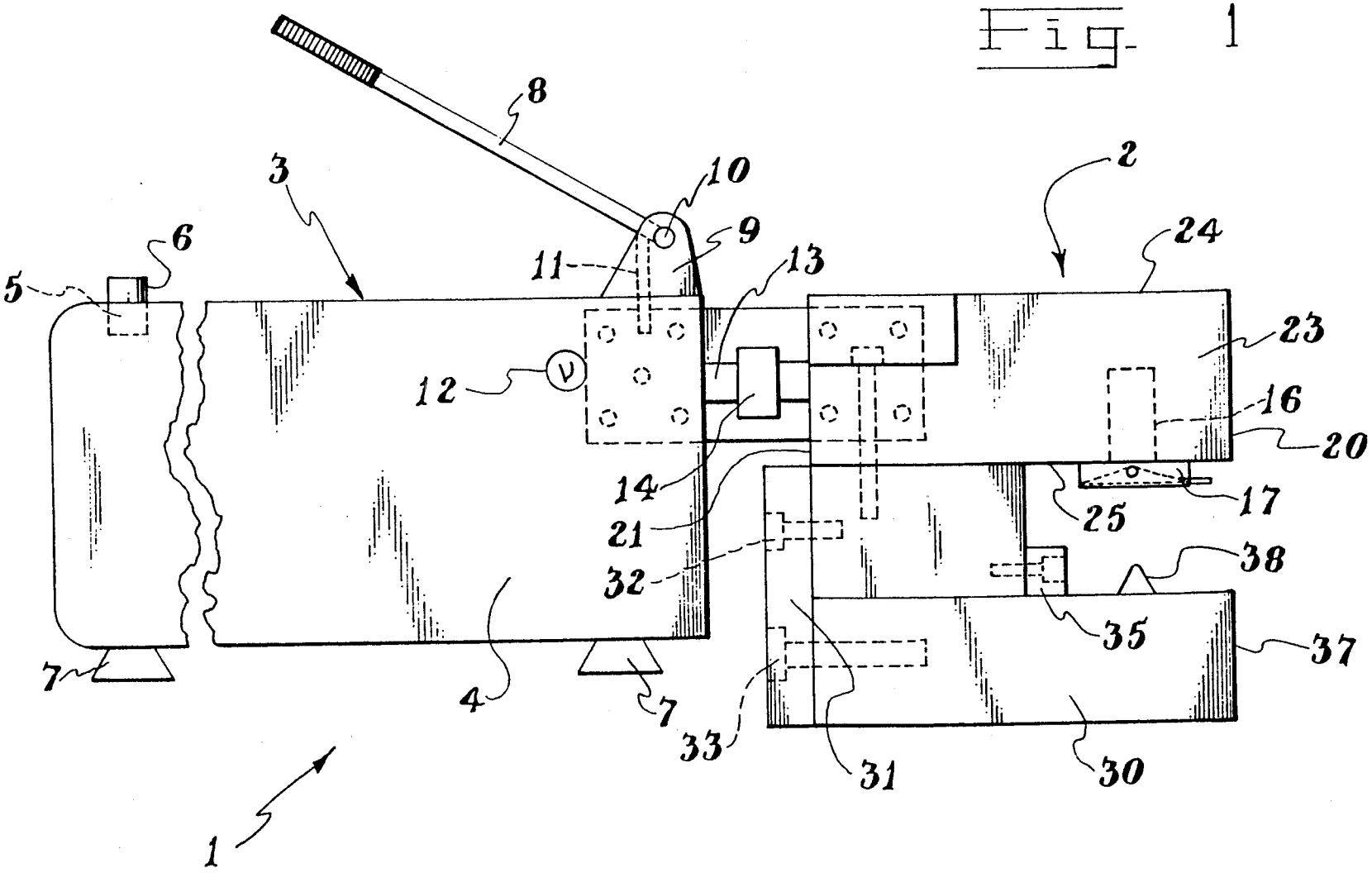
FIG. 1 is a side view of one of the devices of this invention.

With regard to FIG. 1 there is shown a side view of one of the devices 1 of the instant invention which is a combination of the deforming head 2 and a power source 3. Regarding the power source 3, the power source 3 comprises a barrel 4 (which is fragmented in order to reduce the size of the figure) which is designed as a storage container for hydraulic fluid. The barrel 4 has on its surface a filling port 5, which is capped with a removable cap 6 which filling port 5 is usually placed on or near the top of the barrel to accomodate the removing and filling of the barrel 4 with the hydraulic fluid. Also shown in FIG. 1 is a pair of legs 7 (only one leg is shown in FIG. 1) which serve to support the device 1, however, such a device is useful without such legs 7 and they are not regarded as essential to this invention. Also shown is a handle 8 which is rotatably connected in a saddle support 9 (the back saddle is not shown in FIG. 1) by a pin 10 such that the handle 8 can move in a motion that will enable it to actuate a piston 11 ( shown in phantom in FIG. 1) in order to create pressure in the barrel 4. In addition, the barrel 4 has situated on its outer surface, a pressure relief valve 12, which allows any pressure that has been caused by the movement of the handle 8 and the valve 11, to be released back to atmospheric pressure.

The power source 3 is connected to the deforming head 2 by a hydraulic line 13 using a standard coupling 14 such that the hydraulic fluid contained in the barrel 4, when pressurized, will flow into the deforming head through a second internal hydraulic line 15 (shown in FIG. 2), and contact a piston 16, which actuates a die holder 17.

The power source 3, without the deforming head is commercially available from several manufacturers, the most preferred being a power source manufactured by and sold under the commercial name of Enerpac.

The other part of the combination of the invention, the deforming head 2, is shown in FIG. 1 whereby several of the internal components are shown in phantom. A clearer understanding of the internal components can be observed by studying FIG. 2, which is a side sectional view through A—A of FIG. 1.

Figure 2:
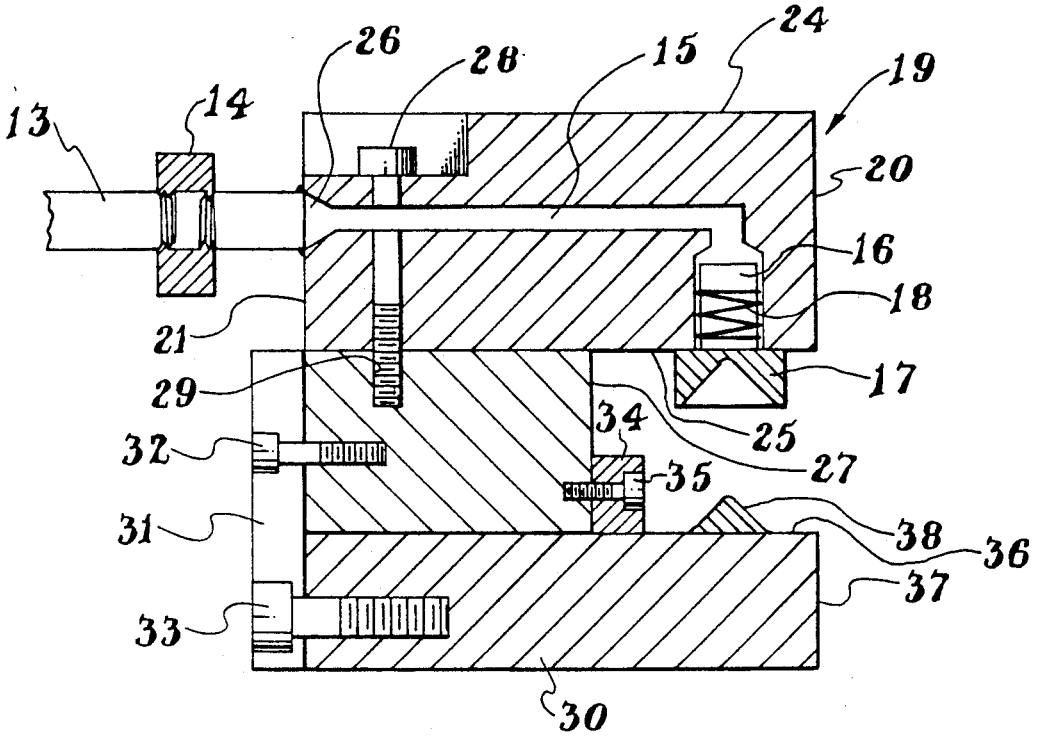
FIG. 2 is a side sectional view of the deforming head of this invention, through the line A—A of FIG. 1.

Thus, in FIG. 2, there is shown the hydraulic line 13, the standard coupling 14 along with a second internal hydraulic line 15, piston 16, and a die holder 17, the second internal hydraulic line 15, piston 16, as well as a return spring 18 for the piston, are all shown contained in the hydraulic block 19.

The hydraulic block 19 has a front wall 20, a back wall 21, an outside wall 22 (not shown, but located opposite the inside wall 23), an inside wall 23 (see FIG. 1), a top 24, and a bottom 25.

The hydraulic block 19 has at least one entry port 26 located in the back wall 21 for the attachment of the hydraulic line 13 to the hydraulic block 19.

The hydraulic block 19 is the support for, and the attachment point, for several of the other parts of the deforming head 2. For example, there is a connector block 27, which is useful as a solid substrate for the connection of the other parts of the deforming head. The connector block 27 is solidly connected to the deforming head 2 by a threaded machine screw 28, which is countersunk in the deforming head 2, and passes through a threaded hole 29 in the bottom of the deforming head 2, and then passes on into the connector block 27 by way of the continuation of the threaded hole 29. This connection binds the deforming head 2 and the connector block 27 so that other parts may be solidly fitted thereto. For example, there is shown a platform block 30 which is bound to the connector block 27 by a common supporting plate 31, and the use of threaded machine screws 32 and 33. This combination hold the flatform block snugly to the connector block 27. Situated in front of the connector block 27 is a pipe stop 34, which is solidly attached to the front of the connector block 27 by a countersunk threaded machine screw 35. The pipe stop 34 is designed to be a stop for the end of any pipe that is inserted therein and thus the pipe stop 34 determines the exact depth that the pipe is inserted into the deforming head 2. This arrangement means that the pipes that are treated by the device all have the deformation at precisely the same spot on them, thus making the process of deforming the pipe uniform from pipe to pipe.

Centered on the upper surface 36 of the platform block 30, and near the front surface 37 of the platform block 30, is a deforming pin 38, which is fitted to conform with the underside of the die 17. Thus, the die 17 and the deforming pin 38 must be in vertical alignment for correct operation of the device.

Figure 3:
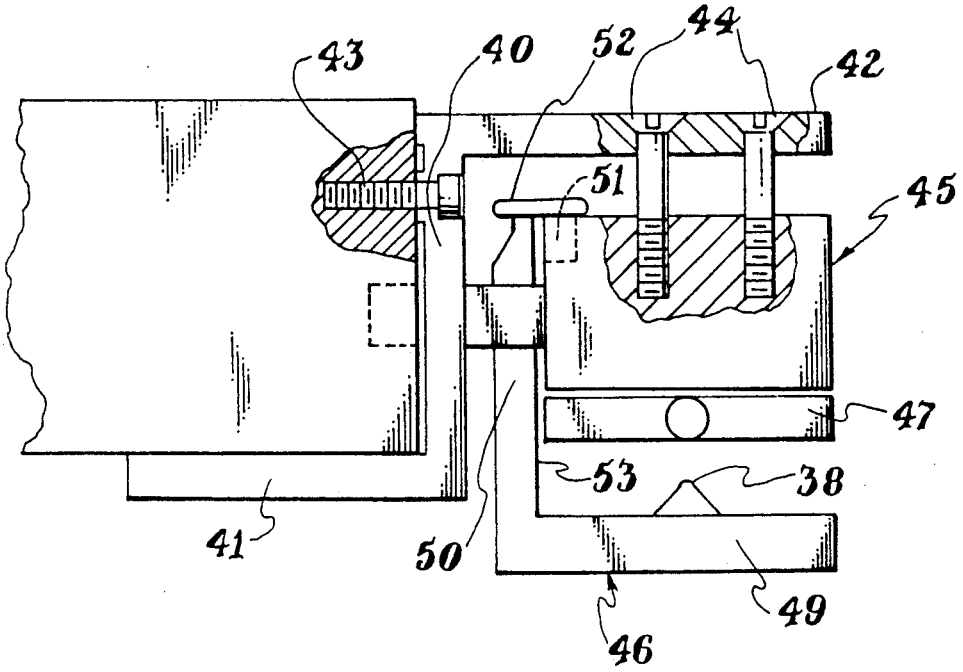
FIG. 3 is a side view of another embodiment of a device of this invention showing a configuration that accomodates a very small device.

There is shown in FIG. 3 another embodiment, which is a lightweight, small version of the device of this invention. With reference to FIG. 3, there is shown the barrel 4 of the hydraulic power source. Mounted on the front 39 of the barrel 4, is a bracket 40, which is an S-shaped bracket whose lower limb 41 extends under the barrel 4, while its upper limb 42 extends from the front 39 of the barrel 4. The bracket 40 is mounted to the barrel 4 by a threaded machine screw 43.

Suspended from the upper limb 42 of the bracket 40 is the hydraulic block 45, said hydraulic block 45 being suspended from the bracket 40 by a set of threaded machine screws 44.

There is also shown the hydraulic line 13 which is connected to the back of the hydraulic block 45 to supply hydraulic fluid to the hydraulic block 45. Not shown are the internal working parts of the hydraulic block 45, as they have been detailed supra.

With further reference to FIG. 3, there is shown holder 46 and a die holder 47, the configuration in the face of the die holder 47 being in vertical alignment with a deforming pin 38, located on the upper surface 48 of the holder 46.

The holder 46 is comprised of an integral L-shaped piece, which has a horizontal leg 49 and a vertical leg 50. Ther vertical leg 50 extends clear to the top of the hydraulic block 45 and is detachedly coupled to a pin 51 mounted in the top of the hydraulic block 45 by a clamp 52. The clamp 52 is easily removable and thereby allows one to change the deforming pin 38 without dismantling all of the device. The front surface 53 of the vertical leg 59 thus acts as the pipe stop for this particular embodiment of the invention.

Just as in the first embodiment of this invention, the power source is connected to the deforming head 2 by a hydraulic line using a standard coupling such that the hydraulic fluid contained in the barrel, when pressurized, will flow into the deforming head through a second internal hydraulic line and contact a piston, which actuates the die holder, which moves the die to the deforming pin 38.

When any of the devices described herein are put into service, and with reference specifically to FIG. 3, for illustration purposes, one just simply moves the device to the end of a piece of smooth pipe, inserts the device over the end of the pipe such that the pipe end contacts the pipe stop and the pipe is situated between the die holder 47 and the deforming pin 38, pressurizes the hydraulic block 45 which actuates the piston 16 (FIG. 2), which acutates the die holder 47, which compresses the pipe, and forces it into the deforming pin 38, which causes a dimple-like deformation in the outer surface of the pipe.

It should be recognized by those skilled in the art that the deformation head is manufactured from metals that are strong enough to undergo the rigors of deforming metal pipe.

I claim:

1. A method of preparing deformed smooth pipe, the method comprising providing a deforming device which comprises in combination, a power source, and connected thereto, a deforming head, said deforming head comprising:

a hydraulic block containing a hydraulically operated piston; said hydraulic block having a front wall, a back wall, a top, and a bottom;

said hydraulic block having through its back at least one entry port and connected to each said entry port, a hydraulic fluid line, the combination of each entry port and hydraulic line being for the transfer of hydraulic fluid into and out of the hydraulic block;

a connector block, said connector block having a top, a bottom, a back, and a front, said connector block being detachedly rigidly mounted with its top to the bottom of the hydraulic block;

a platform block, said platform block having a top and a back, said platform block being detachedly rigidly mounted by its top to the bottom of the connector block;

said platform block having rigidly mounted on its top, a deforming pin;

a supporting plate, said supporting plate having a front, said supporting plate being detachedly rigidly mounted at its front to the back of the connector block and the back of the platform block;

said connector block having detachedly rigidly mounted on its front, a pipe stop;

said hydraulic block having rigidly mounted on its bottom near the front wall, a die holder, said die holder being situated such that any die located therein will be in vertical alignment with said deforming pin;

the pipe stop, connector block, platform block, and supporting plate forming a subcombination which subcombination is adjustable in a vertical line, and removable from the hydraulic block, said subcombination being held by at least one adjustable threaded fastener which adjustable threaded fastener is insertably mounted through a vertical hole which accommodates the adjustable threaded fastener in the top of the hydraulic block;

said hydraulic block being rigidly attached to the power source by a mounting bracket; and (I) applying said deforming device onto the end of a smooth pipe;

(II) deforming the smooth pipe;

(III) removing said deforming device, whereby a deformed smooth pipe is obtained.

* * * * *